US009350097B2

(12) United States Patent
Yunoki

(10) Patent No.: US 9,350,097 B2
(45) Date of Patent: May 24, 2016

(54) ELECTRICAL CONNECTOR

(71) Applicant: Hirose Electric Co., Ltd., Tokyo (JP)

(72) Inventor: Toru Yunoki, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 60 days.

(21) Appl. No.: 14/299,067

(22) Filed: Jun. 9, 2014

(65) Prior Publication Data

US 2014/0364003 A1 Dec. 11, 2014

(30) Foreign Application Priority Data

Jun. 10, 2013 (JP) ..... 2013-121740

(51) Int. Cl.

| | |
|---|---|
| ***H01R 13/64*** | (2006.01) |
| ***H01R 12/71*** | (2011.01) |
| *H01R 12/70* | (2011.01) |
| *H01R 13/6594* | (2011.01) |

(52) U.S. Cl.

CPC ..... *H01R 12/716* (2013.01); *H01R 12/7005* (2013.01); *H01R 13/6594* (2013.01)

(58) Field of Classification Search

CPC ..... H01R 12/716; H01R 12/7005; H01R 13/6594; H01R 13/6597

USPC ..... 439/65, 83, 374, 607.35

See application file for complete search history.

(56) References Cited

U.S. PATENT DOCUMENTS 7,568,919 B2 * 8/2009 Hoshino ..... H01R 12/716 439/74

7,585,185 B2 * 9/2009 Obikane ..... H01R 13/65802 439/108

FOREIGN PATENT DOCUMENTS

| | | | |
|---|---|---|---|
| JP | 2006-059589 A | | 3/2006 |
| JP | 2013-065541 A | | 4/2013 |
| JP | 2013-101909 | * | 5/2013 |

* cited by examiner

*Primary Examiner* — Khiem Nguyen

(74) *Attorney, Agent, or Firm* — Kubotera & Associates, LLC

(57) ABSTRACT

An electrical connector is to be connected to a mating connector. The electrical connector includes a plurality of terminals; a housing for holing the terminals in a terminal arrangement direction; and a guide member for guiding the mating connector. The housing includes a sidewall portion and an edge wall portion connected to the sidewall portion. The guide member includes a first attaching portion, a second attaching portion, and a connecting portion connecting the first attaching portion and the second attaching portion. The first attaching portion is attached to the sidewall portion. The second attaching portion is attached to the edge wall portion.

7 Claims, 9 Drawing Sheets

ELECTRICAL CONNECTOR

BACKGROUND OF THE INVENTION AND RELATED ART STATEMENT

The present invention relates to an electrical connector having a guide metal member. In particular, the present invention relates to an electrical connector having a guide metal member for guiding a mating connector when the electrical connector is connected to the mating connector.

A conventional electrical connector is to be inserted to or removed from a mating connector, and often includes a guide metal member for guiding the mating connector upon fitting/inserting the mating connector thereto. Patent Reference has disclosed such a conventional electrical connector.

Patent Reference: Japanese Patent Application Publication No. 2006-59589

In the conventional electrical connector disclosed in Patent reference, the conventional electrical connector (referred to as a plug connector B in Patent reference) includes a housing, and a space is formed and surrounded by a circumferential wall composed of side walls and end walls of the housing as a receiving section for fitting/inserting a mating connector. The conventional electrical connector includes a side shield and an end side shield made of a metal plate disposed on outer surfaces of the side walls and the end walls forming outer circumferential surfaces of the circumferential wall. The side shield and the end side shield are held such that the side shield and the end side shield partially contact to each other, thereby forming a frame-shape shielding member.

In the conventional electrical connector disclosed in Patent reference, the side shield and the end side shield include contact pieces that extend from upper edges thereof and bent to inverse U-shapes, so that the contact pieces form shield contact piece sections of the mating connector after the conventional electrical connector is fitted to the mating connector.

According to Patent Reference, it has not been clearly disclosed how the side shield and the end side shield are attached to the housing. It appears that the side shield is formed in a strip shape and disposed to the side walls of the housing so as to contact with the side walls with surfaces thereof. A step-shape groove section is disposed at both ends of a groove section formed in the outer surfaces of the side walls, so that inner walls of the step-shape groove section tightly press and hold the end surfaces of the side shield in the longitudinal direction.

In the conventional electrical connector disclosed in Patent reference, the end side shield is formed through bending a metal plate in a thickness direction thereof so as to form a 90-degree rotated U-shape when viewed in the connector fitting direction. Further, the end side shield includes open end leg sections facing each other, and the open end leg sections are tilted to close to each other. Accordingly, the open end leg sections of the end side shield are considered to hold and tightly press one end portion of the side shield from outside. When the open leg sections of the end side shield elastically hold and tightly press the side shield, the end side shield is electrically connected to the side shield in a state the end side shield is held. As a result, the side shield and the end side shield form the frame-shape shield member.

In the conventional electrical connector disclosed in Patent reference, the shield member is arranged to surround the housing thereof. Accordingly, even when the conventional electrical connector is repeatedly inserted to and removed from the mating connector, it is possible to protect the housing from wear and damage at the contact surfaces thereof due to repetitive insertion/removal. Further, it is also possible to improve strength of the conventional electrical connector.

In the conventional electrical connector disclosed in Patent reference, the shield contact pieces provided in the shield member are bent downward to form the inverse U-shape on an inner side thereof, which is to be a side of a receiving section thereof. Further, the free end-side portions of the shield contact pieces are provided protruding inward toward the receiving section relative to the inner surface of the circumferential wall. Therefore, when the conventional electrical connector is fitted to the mating connector, the shield contact pieces function as guide metal members that contact with and guide corresponding sections of the shield member of the mating connector while elastically deforming.

In the conventional electrical connector disclosed in Patent reference, the side shield is provided with a protrusion on a side of an inner surface of the shield contact piece thereof. The end side shield is provided with holes on the inner side of the shield contact pieces. Accordingly, when the conventional electrical connector is fitted to the mating connector, the holes and the protrusions engage and contact with hole and protrusions provided at corresponding parts on a shield member of the mating connector, so that the shield contact pieces can be connected to each other.

In the conventional electrical connector disclosed in Patent reference, the shield contact piece of the side shield and the shield contact piece of the side shield have the inverse U-shape. Further, one of two legs of the inverse U-shape becomes a free end and is not supported by the housing to form a gap from the housing so as to enable elastic displacement, so that the shield contact piece can deform elastically. Accordingly, it is possible to securely contact the shield contact pieces of the conventional electrical connector with the shield contact pieces of the mating connector.

In the conventional electrical connector disclosed in Patent reference, when the shielding contact pieces elastically contact with the mating shielding contact pieces, the shielding contact pieces generate a contact pressure corresponding to an amount of the elastic displacement thereof at the contacting part thereof. Accordingly, the shielding contact pieces receive counterforce from the mating shielding contact pieces, and the protrusions and the holes engage with each other. Therefore, when the conventional electrical connector is disconnected from the mating connector, in addition to a force corresponding to the engaging force of the protrusions and the holes, it is necessary to apply a force greater than a frictional force generated by the counterforce due to the contact force to the mating connector to remove the mating connector from the conventional electrical connector.

In the conventional electrical connector disclosed in Patent reference, as described above, the shielding contact pieces are not completely supported by the housing, so that the shielding contact pieces can freely and elastically displace. Accordingly, when the force is applied to the shielding contact pieces, the shielding contact pieces may deform not only in the direction of the contact pressure but also in the pullout direction. When the shielding contact pieces receive such a force to pull out the conventional electrical connector from the mating connector, the shielding contact pieces may cause plastic deformation and damage. Further, it is difficult to provide a sufficient strength for protecting the housing with the shield member.

In view of the problems described above, an object of the present invention is to provide an electrical connector having a guide metal member capable of effectively protecting a housing thereof while guiding a mating connector when the electrical connector is connected to the mating connector.

Further, even when the electrical connector is repeatedly connected to and pulled out from the mating connector, it is possible to minimize wear and damage of the electrical connector.

Further objects and advantages of the present invention will be apparent from the following description of the present invention.

SUMMARY OF THE PRESENT INVENTION

According to a first aspect of the present invention, an electrical connector having guide metal members includes a circumferential wall formed by a pair of side walls, which rise form a circumferential part of a bottom wall of a housing and extend in a longitudinal direction of the housing, and a pair of end walls, which join end sections of the side walls in the longitudinal direction along a lateral direction perpendicular to the longitudinal direction.

According to the first aspect of the present invention, the housing includes a receiving section for receiving a mating connector from above, and guide metal members attached outside a range where terminals are arranged and at both end sections of the side walls in the longitudinal direction. Each of the guide metal members is made through bending a flat metal member in a sheet thickness direction thereof, and the guide metal members are attached to the housing such that a sheet surface of the guide metal member faces a corresponding wall surface of the circumferential wall.

According to the first aspect of the present invention, in the electrical connector having the guide metal members, each of the guide metal members includes sections to be attached for attaching to attachment sections formed on a side of an end section of the side walls, and a joining section that join the sections to be attached. Each of the sections to be attached is generally formed in an inverse U-shape, and attached so as to cover the attachment section of the side wall from above, and has a guide surface that is a slanted surface on an upper surface. The joining section is provided along an inner wall surface on a side of the receiving section of the end wall or bottom wall. The sections to be attached can slide and contact with the mating connector at the guide surfaces of the sections to be attached, so as to be capable of guiding the mating connector upon fitting the electrical connector to the mating connector.

According to the first aspect of the present invention, in the electrical connector having the configuration described above, each (with the inverse U-shape) of the sections to be attached is disposed on the attachment section of the side wall so as to cover from above, and held by inner and outer wall surfaces of the side walls. Therefore, the guide metal members are maintained at fixed positions without elastic deformation and provide enhanced holding strength.

According to the first aspect of the present invention, the sections to be attached are joined with the joining section, and the joining section is disposed on an inner surface of the end wall and thereby the joining distance is made minimum. Accordingly, it is possible to increase the joining strength, thereby obtaining an enhanced strength of the guide metal members. The slanted surface formed on the upper surface of each of the sections to be attached of each of the guide metal members serves as a guide surface and guides the mating connector upon fitting. Accordingly, in addition to enhanced wear resistance due to the face that the guide metal members are made of metal, the strength of the guide metal members are strengthened by holding the sections to be attached at the fixed positions and joining at the joining sections. As a result, it is possible to prevent the electrical connector from coming off from the mating connector, and also prevent plastic deformation and damage thereof.

According to a second aspect of the present invention, each of the guide metal members preferably has an auxiliary section to be attached, which rises from the joining section and is generally formed in an inverse U-shape. The auxiliary section to be attached is preferably mounted on an auxiliary attachment section of an end wall of the mating connector, which is provided corresponding to the auxiliary section to be attached, so that the auxiliary section to be attached covers the auxiliary attachment section from above.

According to the second aspect of the present invention, similarly to the sections to be attached, the auxiliary section to be attached is generally formed in the inverse U-shape and is disposed to the end wall from above. Accordingly, it is possible to improve strength of the guide metal member similarly to the sections to be attached. Therefore, the guide metal members can enhance the strength by the number of the auxiliary sections to be attached in comparison with a case of having only two sections to be attached. For example, when one auxiliary section to be attached is provided, it is possible to improve strength $(2+1)/2=1.5$ times as rough estimate.

According to the second aspect of the present invention, the auxiliary section to be attached rises from a middle of the joining section, so that it is achievable to reinforce the joining section itself, thereby further enhancing strength of the guide metal member.

According to a third aspect of the present invention, the guide metal member is preferably accommodated in a wide section formed at a corresponding part of the side wall and a corresponding part of the end wall. The wide section is formed to have a receiving section having a large inner width in the longitudinal direction and the lateral direction for the same dimension as the plate thickness of the guide metal member. When the guide metal member is accommodated in the wide section, the guide metal member is situated at the same level as inner surfaces of the side walls of the housing. Accordingly, it is possible to smoothly guide the mating connector upon fitting the electrical connector. Further, it is possible to enhance strength of the guide metal member upon guiding the mating connector through the metal surface thereof.

According to a fourth aspect of the present invention, in the guide metal member, at least the sections to be attached preferably extend downward to a level of a lower surface of the bottom wall of the housing along an outer surface of the circumferential wall, so that the sections to be attached can be attached by soldering to a soldering attachment section of a member to which the electrical connector is attached. When the sections to be attached are attached to the member to which the electrical connector is attached, e.g., a soldering attachment section of a circuit board, it is achievable to use the guide metal members also as a grounding member, and to attach the electrical connector to the circuit board with improved strength.

As described above, according to the present invention, inverse U-shaped sections to be attached are formed on each guide metal member for guiding the mating connector upon fitting the connectors. The sections to be attached are respectively attached to the two side walls that face each other at ends in the longitudinal direction of the housing, i.e., near the end walls so as to cover the sections to be attached from thereabove. The two sections to be attached are joined by the joining section that is provided along an inner surface of the end wall. Therefore, upon insertion/removal of the mating connector, it is not only achievable to enhance wear resistance by metal-to-metal contact, but also achievable to securely hold the sections to be attached by the inner and outer wall surfaces of the side walls without elastic deformation, so that it is achievable to enhance the strength of the attachment. Furthermore, since the sections to be attached are joined by the joining section, which is formed short since it is provided on a side of the inner surface of the end wall, it is also achievable to enhance the strength of each guide metal members itself.

BRIEF DESCRIPTION OF THE DRAWINGS

FIGS. 1(A) and 1(B) are perspective views showing one connector (receptacle connector) and the other connector (plug connector) as a mating connector thereof, which compose an electrical connector assembled component according to an embodiment of the present invention, wherein FIG. 1(A) is the view of the one connector and FIG. 1(B) is the view of the other connector, both of which are shown with their respective fitting sides are directed upward in the views;

DETAILED DESCRIPTION OF THE PREFERRED EMBODIMENTS

Hereunder, an embodiment of the present invention will be described with reference to the accompanying drawings.

Figure 1:
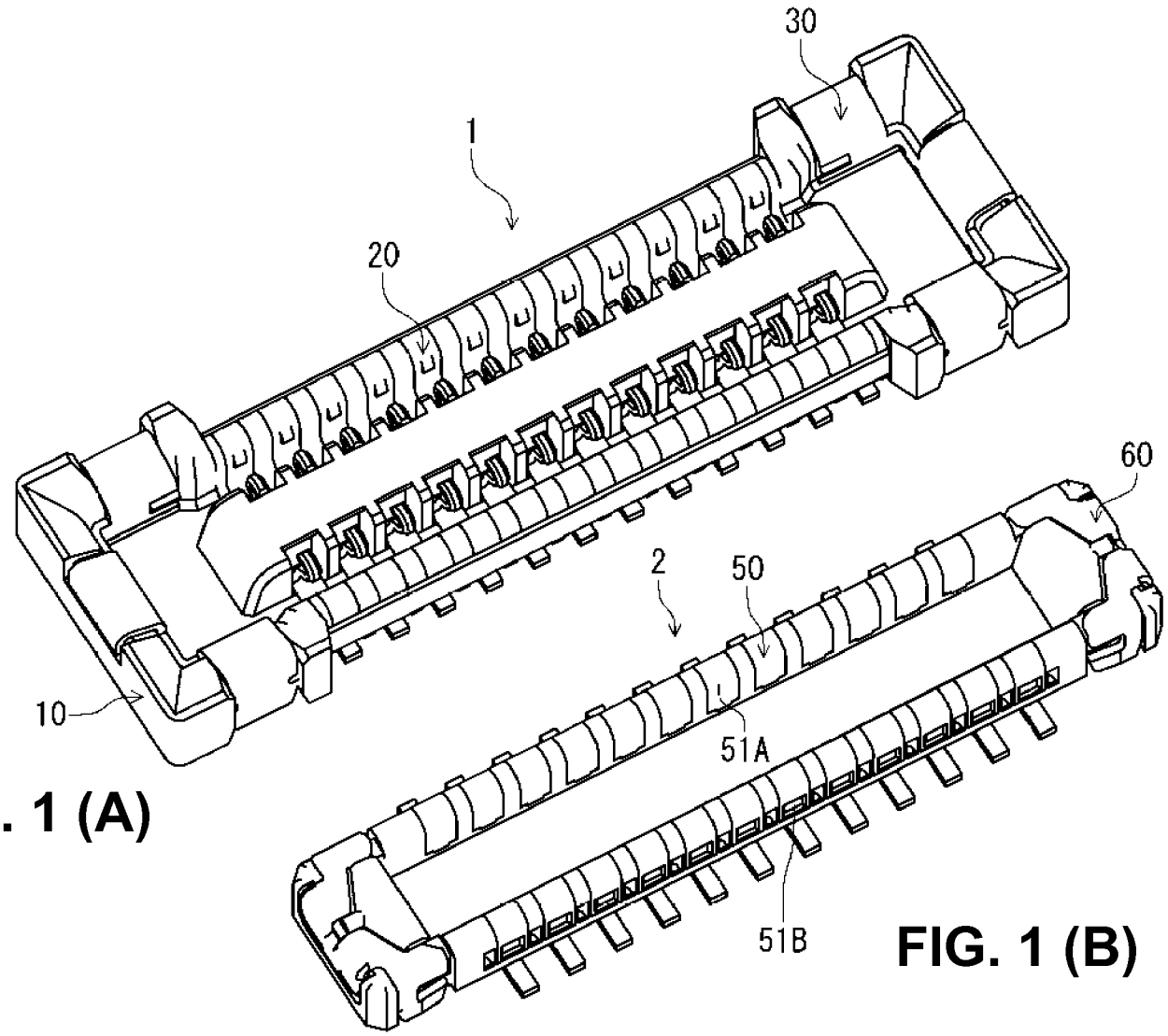

FIGS. 1(A) and 1(B) are perspective views of a receptacle connector 1 (hereinafter referred to as "connector 1") and a plug connector (hereinafter referred to as "mating connector 2) as a mating connector that fits to the receptacle connector 1 from thereabove, according to an embodiment of the present invention, respectively. Both the connector 1 (receptacle connector of FIG. 1(A)) and the mating connector 2 (plug connector of FIG. 1(B)) are shown in a state before fitting the connectors 1 and 2, with their fitting sides directed upward.

Figure 2:
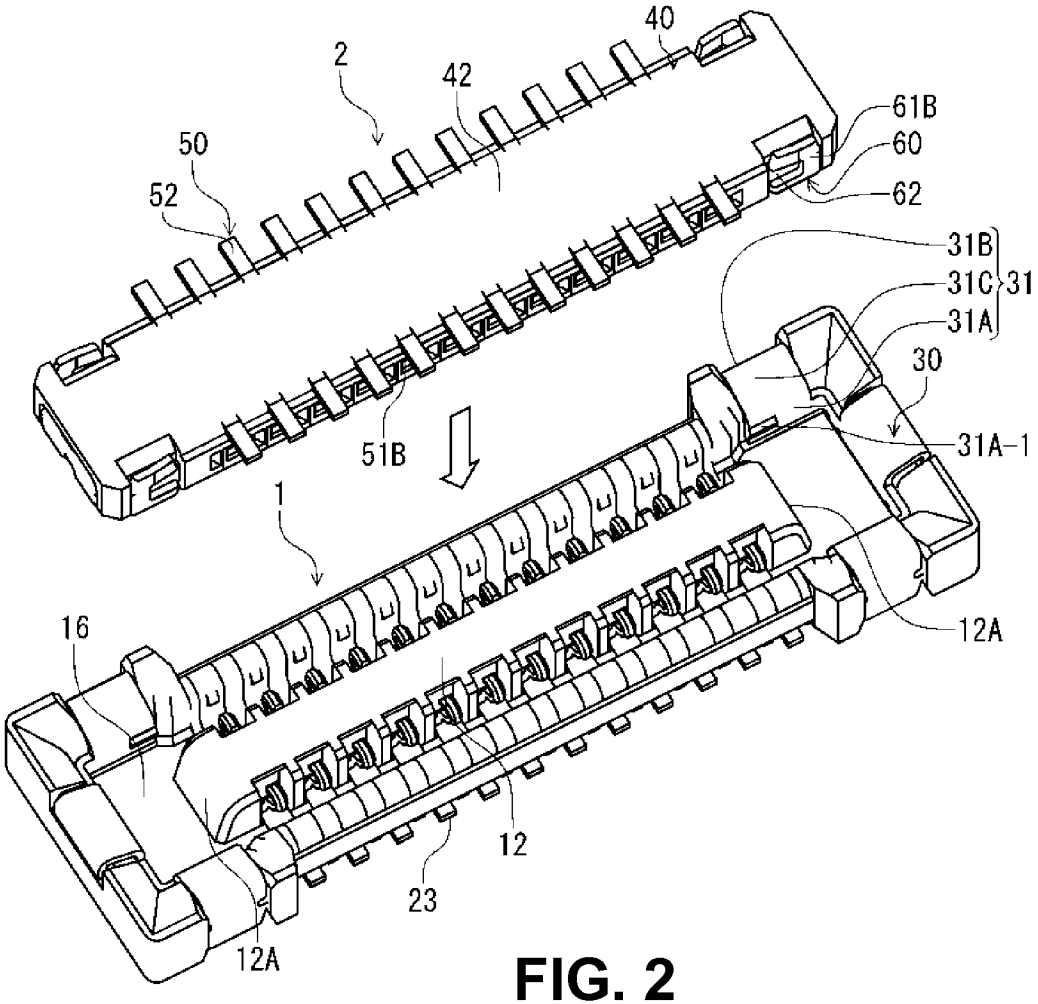
FIG. 2 is a perspective view showing positions and orientations of the connectors of FIG. 1 right before fitting.

FIG. 2 is a perspective view of the both connectors 1 and 2 right before fitting the mating connector 2 to the connector 1, in which the mating connector 2 is disposed above the connector 1 so as to fit the mating connector 2 to the connector 1 from thereabove. Although the connector 1 is disposed similarly to FIG. 1(A), the mating connector 2 is flipped upside down from that shown in FIG. 1(B).

The connector 1 and the mating connector 2 according to the embodiment are electrical connectors for mounting on circuit boards, which are to be disposed on mounting surfaces of separate circuit boards (not illustrated). The connector 1 and the mating connector 2 compose a connector assembled component with a connector's insertion/removal direction being perpendicular to the surfaces of the respective circuit boards (an up-and-down direction in FIG. 2). For description of the embodiment in this specification, a direction of fitting the mating connector 2 to the connector 1, i.e., a direction of moving the mating connector 2 downward in FIG. 2, is referred to as "connector's fitting direction", and the opposite direction thereof, i.e., an upward direction in FIG. 2, is referred to as "connector's removal direction".

Of the connector 1 and the mating connector 2, the connector 1 will be first described. As shown in FIGS. 1(A) and 2, the connector 1 includes a housing 10 that has an outer shape of a generally thin rectangular parallelepiped; a plurality of terminals 20 that is arranged and held in two rows in the housing 10 along a terminal arrangement direction that is a longitudinal direction of the housing 10; and guide metal members 30 that are held at end sections of the housing 10, which are provided at ends of the housing 10 in the longitudinal direction, and guide the mating connector 2. Being orientated as shown in FIG. 2, the connector 1 is disposed and mounted on a circuit board.

The housing 10 is made of an electrically insulating material such as resin, and extends in a longitudinal direction, a direction horizontal to a mounting surface of the circuit board. The housing 10 includes a bottom wall 11 (see FIGS. 2 and 3) horizontal to the mounting surface of the circuit board; an island-like center protruding wall 12 that protrudes upward from the bottom wall 11 and extends in the terminal arrangement direction; and a frame-like circumferential wall 13 that extends upward from a circumferential part of the bottom wall 11 and surrounds the center protruding wall 12. The circumferential wall 13 includes a pair of side walls 14 that extend in the terminal arrangement direction; and a pair of end walls 13 that extend in a connector's width direction, which is perpendicular to the terminal arrangement direction, and join the end sections of the pair of side walls 14. Between the center protruding wall 12 and the circumferential wall 13 that surrounds the center protruding wall 12, there is formed an annular space opened upward, which is formed as a receiving section 16 for receiving a corresponding island-like fitting section of the mating connector 2.

Figure 3:
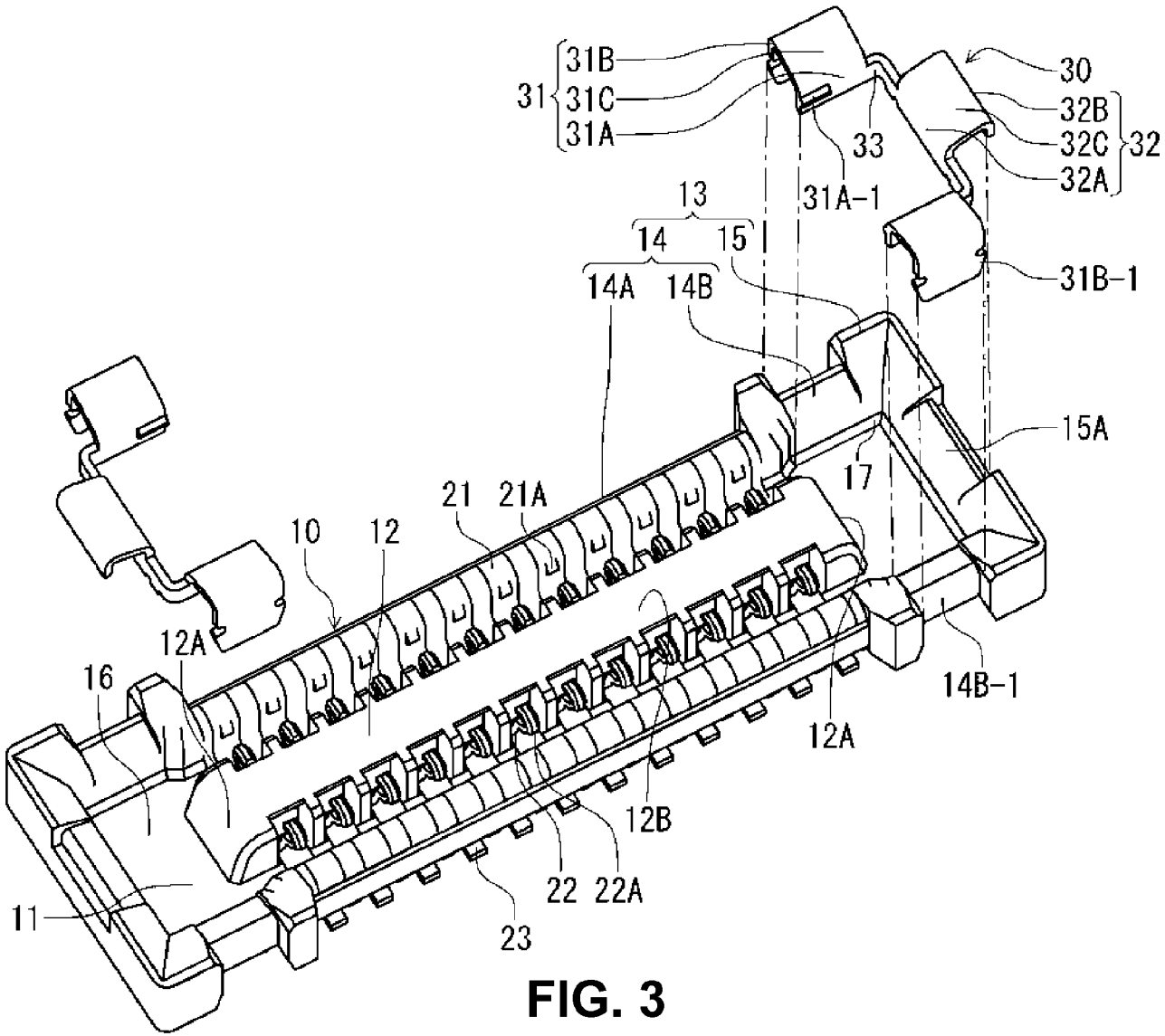
FIG. 3 is a perspective view showing the one connector (receptacle connector) of FIGS. 1 and 2 in a state that guide metal members are separated therefrom.
Figure 4:
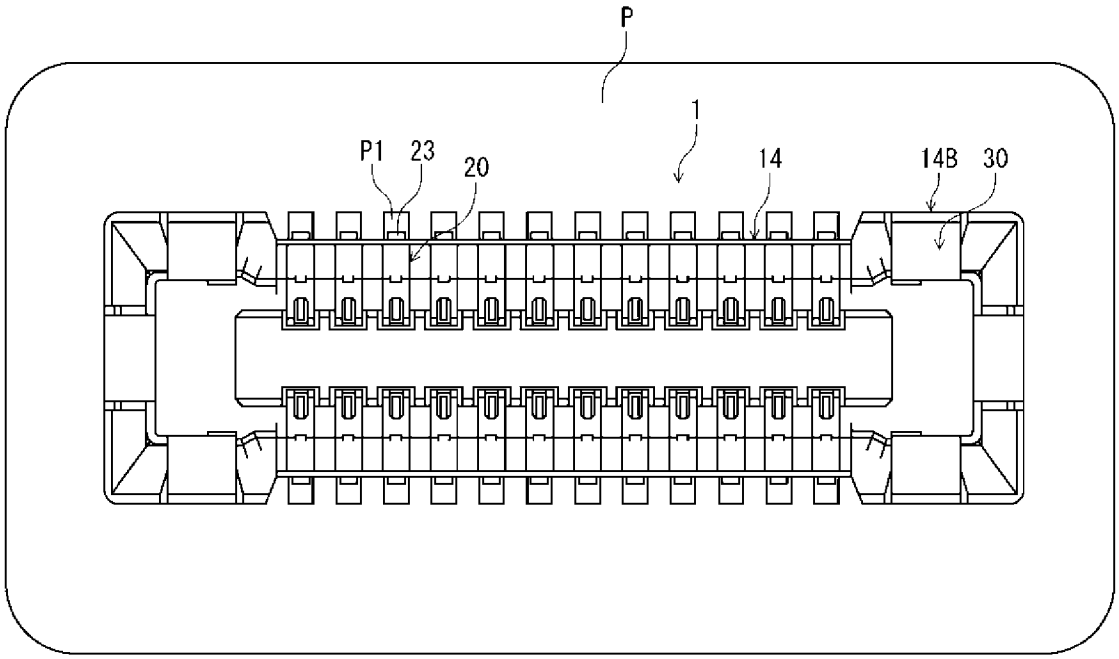
FIG. 4 is a top view of the connector of FIG. 3 when mounted on a circuit board.

As shown in FIGS. 3 and 4, each side wall 14 has terminal holding sections 14A that arrange and hold the plurality of terminals and define the area where terminals are arranged; and attachment sections 14B for attaching the guide metal members 30, which are provided near both ends in the longitudinal direction relative to the terminal holding sections 14A, i.e., outside the terminal arrangement area. The attachment sections 14B are provided projecting further than the terminal holding sections 14A in the connector's width direction, and when viewed from thereabove, the attachment sections 14B project outward in the connector's width direction relative to the terminal holding sections 14A, forming step-like outlines. In other words, when viewed from the above, the connector 1 has a constricted section at the terminal holding sections 14A relative to the attachment sections 14B.

An outer wall surfaces of the attachment sections 14B in the width direction are positioned slightly outside than the connecting sections 23 that extend outward in the width direction from a lower part of the outer wall surfaces of the terminal holding sections 14A, so that the terminals 20 held in the terminal holding sections 14A of the side walls 14 can be connected by soldering to a circuit board P. In addition, inner wall surfaces of the attachment sections 14B in the width direction are also formed wide for the plate thickness of the guide metal members 30, which will be described later, relative to the terminal holding sections 14A. Then, the guide metal members 30 are held at the wide sections.

Once the guide metal members are held at the wide sections, inner leg sections 31A and locking protrusions 31A-1 of the guide metal members 30, inner surfaces of the side walls 14 of the housing 10, and the protrusions 21A formed on the terminals 20 are generally aligned. Accordingly, it is achievable to smoothly guide the mating connector 2 to the connector 1 upon fitting, and improve the strength of the guiding parts because of the metal guiding surfaces. Here, the housing 10 will be described below in further detail in the context of the terminals 20 and the guide metal members 30.

Each terminal 20 is formed bending strip-like sheet metal in a sheet thickness direction thereof, and has a 90-degree rotated S-shape, in which an inverse U-shaped section and U-shaped section are joined. The inverse U-shaped section of each terminal 20 has an inside leg section and an outside leg section, and form a section to be held 21, which is held by the terminal holding section 14A of the side wall 14. The sections to be held 21 are attached to the housing 10, disposing them over the terminal sections 14A, e.g. by integral molding. As such, the inside leg sections and the outside leg sections of the terminals 20 are disposed on inner surfaces and outer surfaces of the side walls 14.

The U-shaped section of each terminal 20 is formed to curve such that the lower bent part is curved to a concave shape along the bottom wall 11 and extends from the lower part of the terminal holding section 14A to the side surface of the center protruding wall 12. A part on a free end of each U-shaped section is disposed on a side surface of the center protruding wall 12 and forms a flexible arm. Each terminal has a protrusion 21A on the inside leg section of the section to be held 21 for contacting and locking a mating terminal thereof. Facing to the protrusion 21A, there is provided a contact section 22A on a side of the free end of the elastic arms 22 of the U-shaped section of each terminal 20, which is bent so as to protrude in a 90-degree rotated V-shape towards the inside leg section.

Each contact section 22A contacts with a mating terminal of the mating connector 2 with certain contact pressure, and on the other side, each protrusion 21A locks so as to prevent from coming off therefrom. The terminals 20 are similarly held on both side walls 14 that face each other, so as to be symmetrically arranged across the island-like center protruding wall 12 in the connector's width direction and arranged at constant intervals in the longitudinal direction. Since the main idea of the present invention is not the terminals, further explanation is omitted.

Each attachment section 14B forms the area for arranging an end section on the side wall 14 in the longitudinal direction, and includes an attachment groove 14B-1 having an equivalent depth to that of the plate thickness of the guide metal member, which will be described later. When viewed as in FIG. 6, each attachment section 14B has an inverse U-shape, which is formed by an upper surface and inner and outer surfaces of the attachment section 14B. At the same position on the side of each end section in the longitudinal direction, on each end wall 15 that joins the attachment sections 14B of the two side walls 14, there is provided an auxiliary attachment section 15A, which is similar to the attachment section 14B, at a center in the connector's width direction. Each auxiliary attachment section 15A also forms an inverse U-shaped outline formed by the upper surfaces and the inner and outer surfaces of the end walls 15, similarly to the attachment section 14B.

In addition, each auxiliary attachment section 15A connects to the attachment sections 14B by joining sections 17 formed near the bottom wall 11 of the housing 10. The two attachment sections 14B, which face each other and have the attachment grooves 14B-1 formed thereon, and the end wall 15, on which the auxiliary attachment section 15A is provided, form a square-bottom U-shape having right angles when viewed from thereabove, and upper surfaces of the U-shape (inner surfaces of the attachment section 14B) is directed inward, i.e., having slanted surfaces that are tilted downward towards the receiving section 16.

Each guide metal member 30 is made by bending sheet metal in a sheet thickness direction thereof. As shown in FIG. 3, each guide metal member includes two sections to be attached 31, which face each other and have inverse U-shapes in a sectional view taken in the connector's width direction so as to be attached to the attachment grooves 14B-1 formed in the attachment sections 14B of the housing 10; auxiliary section to be attached 32 that is formed in an inverse U-shape in a sectional view taken along the longitudinal direction so as to be attached in the auxiliary attachment section 15A formed on the end wall 15 of the housing 10; and a joining section 33 that is provided forming a contact surface or gap on the inner surface of the end wall 15. The two sections to be attached 31 are joined by the joining section 33.

Figure 6:
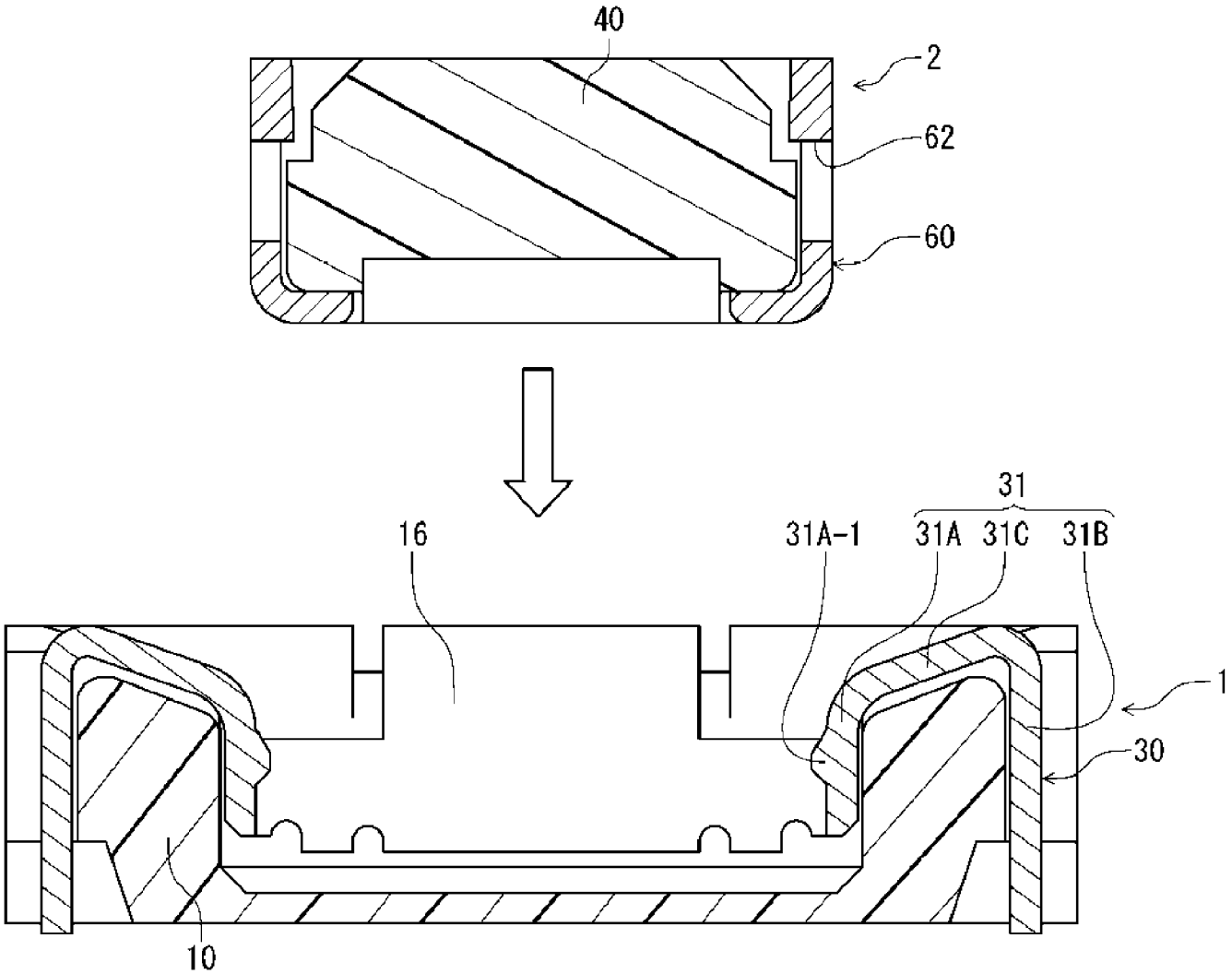
FIG. 6 is a vertical sectional view showing the both connectors of FIG. 1 right before fitting, taken at a position of the guide metal members.

As shown in the sectional view of FIG. 6, each section to be attached 31 includes an inner leg section 31A and an outer leg section 31B, which are provided on an inner side and an outer side of the attachment section 14B on the side wall 14; and an upper flat section 31C that connects the inner leg section 31A and the outer leg section 31B. Each section to be attached 31 has an inverse U-shape when viewed as in FIG. 6, which is formed by the inner leg section 31A, the upper flat section 31C, and the outer leg section 31B. Each section to be attached 31 is pressed to the attachment groove 14B-1 of the attachment section 14B, and after the attachment, the inner surface of the section to be attached 31 is disposed along an inner surface of the attachment section 14B (a surface facing the center protruding wall 12).

Upon pressing/fitting to attach each guide metal member 30 to the attachment groove 14B-1, surfaces of both side edges (the edge surfaces in the connector's longitudinal direction that have width generally equivalent to a thickness of the sheet metal) of the section to be attached 31 receive counterforce from two inner side surfaces facing in the groove's width direction of the attachment groove 14B-1 upon pressing in, and thereby the strength of holding the attachment is enhanced. On each side edge of the outer leg section 31B, there is provided a protrusion 31B, which engages into the attachment groove 14B-1 and strengthen the holding. An upper flat section 31C of the section to be attached 31 forms a slanted surface that tilts inward, i.e., towards the receiving section 16, and forms a guide surface for the mating connector 2.

In addition, on each inner leg section 31A, there is provided a locking protrusion 31A-1 that is thin and extends in the longitudinal direction for locking to a corresponding part of the mating connector 2. Moreover, a vertex of the upper flat section 31C is at the same height as a vertex of the attachment section 14B of the housing 10, and is located inward than the slanted surface formed on the housing 10. Here, the locking protrusion of the guide metal member 30 can be concave shape or slit-like shape. Needless to say, in this case, the corresponding part of the mating connector has a protruding shape.

The auxiliary attachment section 32 rises from an upper edge of the joining section 33 that joins the two sections to be attached 31, is bent downward at a position of an outer surface of the end wall 15, and forms an inverse U-shape when viewed in a sectional view taken along the connector's width direction. Each auxiliary attachment section 32 also has an inner leg section 32A, an outer leg section 32B, and an upper flat section 32C that tilts inward, which form the inverse U-shape, and works similarly to the sections to be attached 31.

In addition, receiving counterforce generated by pressing/fitting to the auxiliary attachment section 15A, the strength of holding the attachment is similarly enhanced. Moreover, a vertex of the upper flat section 32C is generally the same height as a vertex of the end wall 15 of the housing 10, and is located inward than the slanted surface formed on the housing 10. Here, the inner leg section 32A can also have a locking protrusion for engaging with the corresponding part of the mating connector 2.

The inner leg sections 31A of the attachment sections 31 and the inner leg section 32A of the auxiliary attachment section 32 are joined with the joining section 33 thereunder. The joining section 33 forms a contact surface or a gap on a lower part of an inner surface of the circumferential wall 13, and the joining section 33 is bent to form L-shapes at the middle so as to fit to inner corner sections, where the attachment sections 14B and the end wall 15 meet.

The connector 1 is configured such that the center protruding wall 12, which is provided like an island and rises from the bottom wall 11 of the housing 10, has a shape so as to enter the corresponding concave center section of the mating connector 2. On side surfaces of the center protruding wall 12, there is formed a groove to accommodate the elastic arms 22 of the terminals 20, and only contact sections 22A formed to bend from the elastic arms 22 are outside the groove, and the elastic arms 22 can move in the groove according to the elastic displacements of the contact sections 22A.

The end surfaces of the center protruding wall 12 in the longitudinal direction (wall surfaces on both ends in the longitudinal direction) form a continuous slanted surface 12A in a direction to get close to the bottom wall 11 and the end walls 15. According to the embodiment, slopes of the slanted surfaces 12A continuously change relative to the upper surface 12B and the bottom wall 11 so as to have a convex curve and a concave curve, respectively. The continuous slanted surfaces are formed generally over the whole area in a height direction of the center protruding wall 12 without discontinuous slope change.

The slanted surfaces 12A at end surfaces of the center protruding wall 12 in the longitudinal direction, the inner leg section 32A of the auxiliary attachment section 32 of the guide metal member 30, which are disposed on the end wall 15 and faces the slanted surface 12A, and the inner leg sections 31A of the sections to be attached 31, which face in the connector's width direction and provided between the end surface and the inner leg section 32A in the longitudinal direction, form space by surrounding four sides thereof. Into the spaces, fitted are corresponding parts of the mating connector 2.

At this point, there is a convex curved surface as a transitional part to an upper surface 12B on the upper end side of each slanted surface 12A at the end surface of the center protruding wall 12 in the longitudinal direction. On each guide metal member 30, there is the upper flat section 32C of the auxiliary section to be attached 32, and the upper flat sections 31C of the two sections to be attached 31 have slanted surfaces that respectively tilt downward towards inside, and are disposed inner than the slanted surface formed on the housing 10. Therefore, corresponding parts of the mating connector 2 can easily enter the spaces being guided by the slanted surfaces.

As shown in FIG. 4, the terminals 20 of the connector 1 have connecting sections 23 for connecting the connector 1 to a circuit board P, extending outward from a lower part of an outer surface of each terminal holding section 14A on the side walls 14 of the housing 10. The outer surfaces of the attachment sections 14B of the housing 10 are slightly outside than tips of the connecting sections 23 of the terminals 20 in the connector's width direction, so that it is achievable to enhance the strength of the attachment sections. Furthermore, even when soldering pads P1 for connecting by soldering to the connecting sections 23 slightly project from the tips of the connecting sections 23, the range of the circuit board taken by the pads P1 is generally the same as that taken by the attachment sections 14B in the connector's width direction and thereby it is achievable to effectively use the surface space of the circuit board P.

Next, the mating connector 2 will be described. According to the embodiment, similarly to the above-described connector 1, the mating connector 2 is also mounted on a corresponding circuit board for use. Therefore, once the connector 1 and the mating connector 2 are fitted and connected to each other, circuit units of the two circuit boards are connected.

Figure 5:
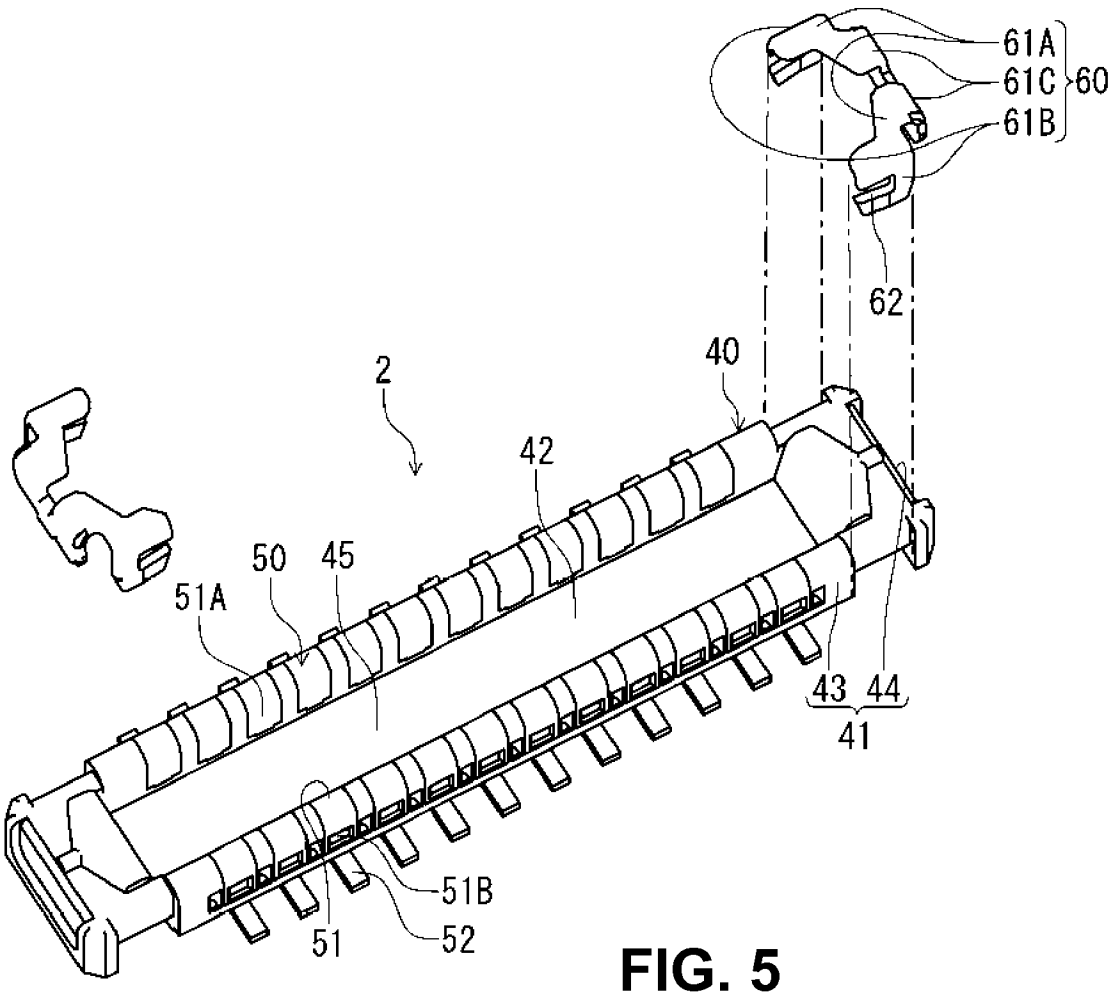
FIG. 5 is a perspective view of the other connector of FIG. 1 in a state that guide metal members are separated therefrom.

As shown in FIG. 5, the mating connector 2 includes a housing 40 made of an electrically insulating material; terminals 50, which are held in the housing 40 and arranged in the longitudinal direction of the housing 40; and guide metal members 60 attached on both ends of the housing 40, which are outside the range where terminals 50 are arranged.

The housing 40 includes a rectangular frame-like circumferential wall 41 and a bottom wall 42, to which the receiving section 16 fits, which is the annular concave section formed by the housing 10 of the connector 1, i.e., the space formed between the island-like center protruding wall 12 and the circumferential wall 13 that surrounds the center protruding wall 12. The circumferential wall 41 includes side walls 43 and end walls 44, and forms a center concave section 45 for receiving the center protruding wall 12 of the connector 1.

Each terminal 50 is made by bending a metal strip member in the sheet thickness direction. Each terminal 50 includes an inverse U-shaped section to be held 51 that is to be held by an upper part (the upper part in FIG. 1(B)) of the side wall 43 of the housing 40, and a connecting section that extends sideways from the bottom wall 42 of the housing 40 and connects by soldering to a circuit board.

A surface of an inner side leg section of each section to be held 51 forms a contact section 51A, to which the contact section 22A provided on the elastic arm 22 of the terminal 20 of the connector 1 elastically contacts. On a surface of the outer side leg section of each section to be held 51, there is provided a locking concave section 51B, to which the protrusion 21A engages for locking the terminal 20. Since the main idea of the present invention is not the terminals, further explanation is omitted.

The guide metal members 60 helps the mating connector 2 to be guided by the guide metal members 30 of the connector 1 to a normal position upon fitting to the connector 1. The both metal fittings 30 and 60 are often somewhat off their normal fitting positions relative to each other, and upon start of the fitting, the guide metal members 30 and 60 contact each other, and the contacting force is relatively strong at end sections and corner sections of the connectors 1 and 2. Therefore, in view of fully coping with impact upon abutting and frictional force in the fitting process, there is significance of using the same metal fittings.

Similarly to the guide metal members 30 of the connector 1, the guide metal members 60 are made bending sheet metal in a sheet thickness direction thereof, are attached to the housing 40 from an upper surface side of the housing 40 at end sections in the longitudinal direction, and integrally include upper surface sections 61A disposed on the upper surface side, side surface sections 61B disposed on outer surfaces of the side walls 43 of the housing 40, and end surface sections 61C disposed on outer surfaces of the end walls 44 of the housing.

As shown in FIG. 2, from each end surface section 61C that extend along the end walls 44 in the connector's width direction, two upper surface sections 61A, which extend towards the two facing side walls 43 with slanted edge, form a V-shaped edge, and are bent downward along outer surfaces of the side walls 43 to form side surface sections 61B, respectively.

On the side surface sections 61B, there are formed engaging slits 62 that extend in the connector's longitudinal directions. Onto the slits 62, locking protrusions 31A-1 engage, which are formed on the sections to be attached 31 of each guide metal member 30 of the connector 1. The guide metal members 30 of the connector 1 have their sections to be attached 31 and the auxiliary sections to be attached 32 extend from inner surface side of the circumferential wall 13 of the housing 10, and the guide metal members 60 of the connector 2 covers the end sections of the circumferential wall 41 from sides of the outer surfaces at end sections of the housing 40.

Lower ends of the side surface sections 61B of each guide metal members 60 are locked at the lower surface of the bottom wall 42 of the housing 40, being bent along the lower surface of the bottom wall 42, as shown in FIG. 2.

As for guiding of the guide metal members 60, the part that ranges from a round shoulder section, which is a border between the upper surface section 61A and the side surface section 61B, to the side surface section 61B is guided by the sections to be attached 31 of the guide metal members 30 of the connector 1, and the part that ranges from round shoulder section, which is a border between the upper surface section 61A and the end surface section 61C to the end surface section 61C is guided by the auxiliary sections to be attached 32 of the guide metal members 30.

Figure 8:
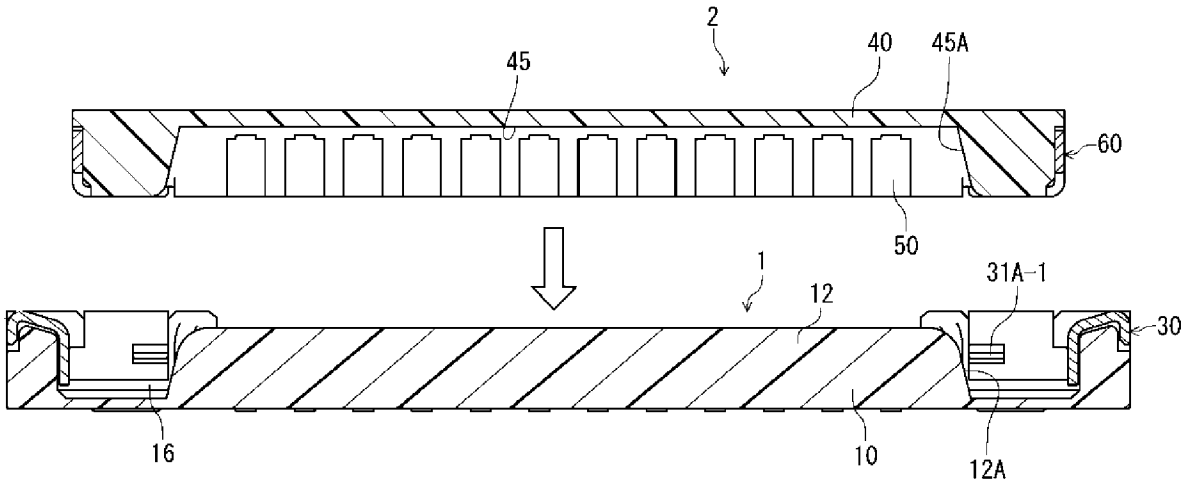
FIG. 8 is a vertical sectional view showing positions and orientations of the connectors of FIG. 1 right before fitting them, taken at a center protruding wall (center concave section) in a longitudinal direction of housings of the connectors.

The inner surfaces of the end walls 44 of the housing 40, i.e., the inner end surfaces of the end sections of the center concave section 45 in the longitudinal direction for receiving the center protruding wall 12 of the connector 1, form slanted surfaces 45A so as to approach the center part in the longitudinal direction as it goes the bottom section of the center concave section 45 (See FIG. 8). The slanted surfaces 45A preferably have generally the same tilting angles as the tilt angles of the slanted surfaces 12A formed on the end surfaces of the center protruding wall 12 of the connector 1 in the longitudinal direction. As such, portions of the housing 40 exposed between the two upper surface sections 61A of the guide metal members 60 (portions shown forming generally V-shapes at upper surfaces of the end walls 44) is provided as the slanted surfaces 45A and are guided to the center protruding wall 12, which is a part of the housing of the connector 1.

The connector 1 and the mating connector 2 configured as described above may be used together as an electrical connector assembled component.

Upon use, the connector 1 and the connector 2 are mounted on circuit boards, respectively, and brought to the positions as shown in FIG. 2 right before fitting. In FIG. 2, illustration of the circuit boards themselves are omitted, but in FIG. 2, the circuit board is disposed on an upper surface of the bottom wall 11 of the connector 1, and the other circuit board is disposed on a lower surface of the bottom wall 42 of the mating connector 2, which is directed upward. The connector 1 and the mating connector 2 face each other in a direction to fit to each other, in a state that the circuit boards are parallel to each other. In the figures of the embodiment, illustration of the circuit boards is omitted except FIG. 4.

Figure 7:
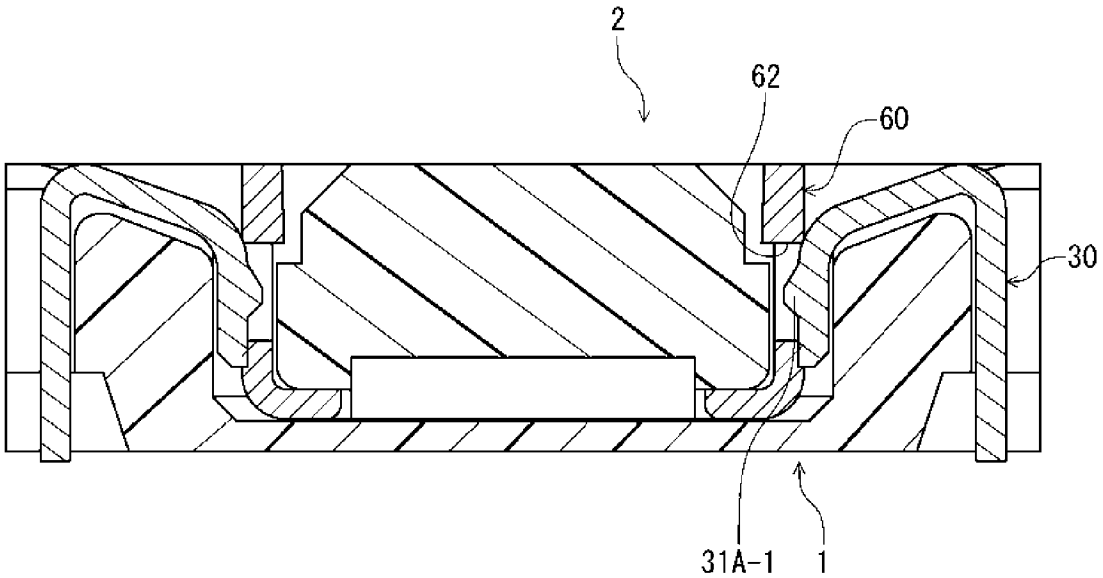
FIG. 7 is a vertical sectional view showing completion of fitting the connectors of FIG. 6, taken at the position of the guide metal members.
Figure 9:
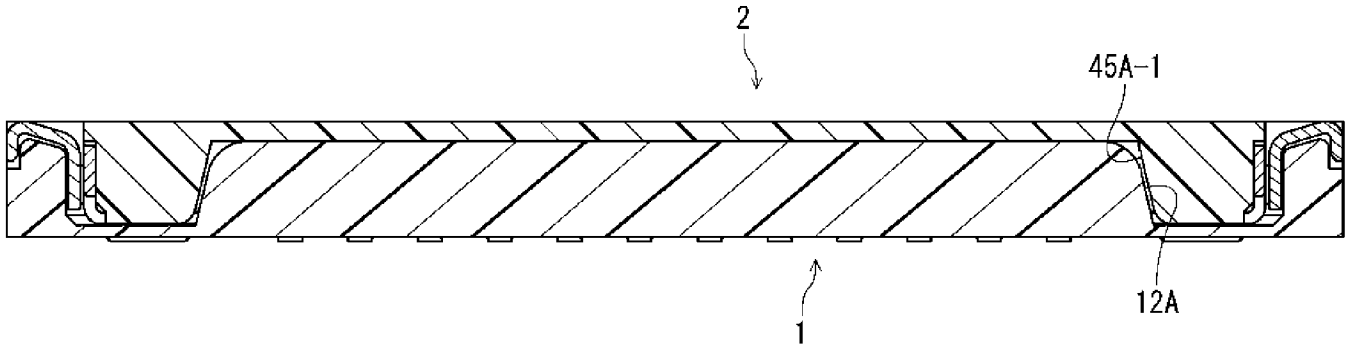
FIG. 9 is a vertical sectional view showing completion of fitting the both connectors of FIG. 8, taken at a center protruding wall (center concave section) in the longitudinal direction.

Being oriented as in FIG. 2 right before fitting, the mating connector 2 is brought down to the connector 1 as is. When the fitting to each other at normal positions is started, the circumferential wall 41 of the mating connector 2 enters the annular receiving section 16 of the connector 1, and then the center protruding wall 12 of the connector 1 enters the center concave section 45 of the mating connector 2, and thereby the two connectors 1 and 2 engages to fit to each other (See FIGS. 7 and 9).

Upon start of the fitting and in the process of the fitting, the guide metal members 30 and 60 slide to contact each other and guide the mating connector 2 to the connector 1. In other words, their respective inner leg sections 31A and 32A of the two sections to be attached 31 and the auxiliary section to be attached 32 of each guide metal member 30 provided in the connector 1 correspondingly slide to contact to the two side surface sections 61B and end surface sections 61C of each guide metal members 60 provided in the connector 2 under a contact condition between the same metal so as to fit and guide each other to the normal positions.

Upon completion of the fitting, the contact sections 22A of the terminals 20 of the connector 1 contact with the contact sections 51A of the terminals 50 of the mating connector 2. The locking protrusions 21A of the terminals 20 engage in the locking concave sections 51B of the mating terminals 50. Accordingly, coming off of the connectors 1 and 2 from each other is prevented. On the other hand, in case of the guide metal members 30 of the connector 1, the locking protrusions 31A-1 engage in the slits 62 of the guide metal members 60 of the mating connector 2, and thereby it is achievable to strongly prevent coming off of the connectors 1 and 2 from each other.

The mating connector 2 may not be always disposed and orientated at normal positions right before the fitting. In actual fitting, the connectors 1 and 2 are often displaced slightly in certain direction and are to be fitted in spite of their tilting relative to each other. Since the bottom wall 42 of the mating connector 2 oriented as shown in FIG. 2 and the circuit board on the bottom wall (not illustrated) is projects around the mating connector 2, it is often difficult to check whether the fitting progresses at the normal positions by visual observation.

For this reason, upon fitting the connectors, typically, the circuit board of the mating connector 2 is brought close to the connector 1 by having only the one end side of the mating connector 2 in the longitudinal direction close to the connector 1, so as to lift the other end in the longitudinal direction to a tilted state. Then, securely start the fitting at one end side, then bring down the other end to fit, and complete the fitting of the whole connectors.

In case of starting the fitting by fitting the mating connector 2 to the connector 1 from one end side in the longitudinal direction, as for the positions of the one end side of the mating connector 2, the end surface sections 61C of the guide metal member 60 of the mating connector 2 slide on the upper flat section 32C formed as a slanted surface on the auxiliary section to be attached 32 of the guide metal member 30 of the connector 1, and is guided inward of the receiving section 16 in the longitudinal direction. Being guided with the inner leg sections 32A of the auxiliary sections to be attached 32 at specific positions, it moves towards the bottom part of the receiving section 16.

When there is displacement from the normal positions in the connector's width direction at the beginning of the fitting, one of the two side surface sections 61B of the guide metal members 60 of the mating connector 2 abut the corresponding one of the two sections to be attached 31 of the guide metal members 30 of the connector 1, slide on the slanted surface of the upper flat section 31C to move in the width direction and reach the normal position, so as to bring to the fitting position at the one end side.

The way of starting the fitting from one end side in the longitudinal direction, which is described above, is often done, and large abutting force is exerted primarily on the one end side. According to the present invention, the guide metal members are provided in areas where such large abutting forces are exerted, and the guide metal members 30 are securely attached to the housing 10, so that it is achievable to improve the wear resistance, improve the guide metal members 30 themselves, and secure the attachment strength of the guide metal members 30 by metal contact with the guide metal members 60 of the mating connector 2.

When fitting of one end side of the mating connector 2 in the longitudinal direction progresses in some amount, and then the other end side starts to be brought down, since the end surface 12A of the center protruding wall 12 of the connector 1 forms a slanted surface on the one end side, the mating connector 2 easily enters the center concave section 45 towards the slanted surfaces 45A formed similarly in the center concave section 45 of the mating connector 2. Upon bringing down the other end side of the mating connector 2 so as to rotate around the one end side, the end surfaces 12A of the center protruding wall 12 in the longitudinal direction and the slanted surfaces 45A of the center concave section 45 smoothly further engage with each other.

In a state of using the connectors after their fitting, when the connector assembled component is accidentally dropped or receives undue force upon removal of the connector 1 or 2, the center protruding wall 12 provided on the housing 10 of the connector 1 is relatively thin and cannot have a metal plate for reinforcement, so that the connector assembled component has to deal with the external force in the longitudinal direction with such small sectional area.

According to the present invention, however, the end surfaces 12A of the center protruding wall 12 of the connector 1 in the longitudinal direction have large thickness in the longitudinal direction, and their corresponding slanted surfaces 45A of the center concave section 45 of the mating connector 2 abut to their corresponding slanted surfaces. By the tilting of the slanted surfaces, the abutting surface areas are increased and thereby the abutting stress is reduced, and the external force is applied in the horizontal direction, i.e., the longitudinal direction.

Accordingly, when the external force works as a component of force perpendicular to the corresponding slanted surface, the component of force itself decreases by the slope, so that the end surfaces 12A in the longitudinal direction significantly contributes not only to the guiding but also to the strength. In addition, when the connector assembled component receives undue force in the width direction, the end surfaces 12A of the center protruding wall 12 of the mating connector 2 has a large thickness in the longitudinal direction, by the end sections of the center protruding wall 12 of the mating connector 2 in the longitudinal direction, force applies in the width direction of the ends of the center protruding wall 12 of the connector 1 in the longitudinal direction, which also significantly contributes to enhancement of the strength.

The disclosure of Japanese Patent Applications No. 2013-12170, filed on Jun. 10, 2014, is incorporated in the application by reference.

While the present invention has been explained with reference to the specific embodiments of the present invention, the explanation is illustrative and the present invention is limited only by the appended claims.

What is claimed is:

1. An electrical connector to be connected to a mating connector, comprising:

a plurality of terminals;

a housing for holing the terminals in a terminal arrangement direction; and a guide member for guiding the mating connector, wherein said housing includes a pair of sidewall portions and an edge wall portion connected to the sidewall portions to form a receiving portion for receiving the mating connector, said guide member includes a first attaching portion, a second attaching portion, and a connecting portion connecting the first attaching portion and the second attaching portion, said connecting portion is disposed inside the receiving portion along the edge wall portion, said first attaching portion is attached to one of the sidewall portions from above, said second attaching portion is attached to the other of the sidewall portions from above, said first attaching portion includes a first inner leg portion situated inside the one of the sidewall portions and a first outer leg portion situated outside the one of the sidewall portions, said second attaching portion includes a second inner leg portion situated inside the other of the sidewall portions and a second outer leg portion situated outside the other of the sidewall portions, and said connecting portion is disposed inside the edge wall portion to connect the first inner leg portion and the second inner leg portion.

2. The electrical connector according to claim 1, wherein said first attaching portion is formed in a U-character shape so that the first attaching portion is attached to the one of the sidewall portions from above.

3. The electrical connector according to claim 1, wherein said guide member further includes a third attaching portion, and said third attaching portion is formed in a U-character shape so that the third attaching portion is attached to the edge wall portion from above.

4. The electrical connector according to claim 1, wherein said one of the sidewall portions includes an expanded portion for accommodating the first attaching portion.

5. The electrical connector according to claim 1, wherein at least one of said first attaching portion and said second attaching portion extends beyond the one of the sidewall portions or the other of the sidewall portions to be connected to an external member with solder.

6. An electrical connector to be connected to a mating connector, comprising:

a plurality of terminals;

a housing for holing the terminals in a terminal arrangement direction; and a guide member for guiding the mating connector, wherein said housing includes a pair of sidewall portions and an edge wall portion connected to the sidewall portions, said guide member includes a first attaching portion, a second attaching portion, and a connecting portion, said first attaching portion includes a first inner leg portion situated inside one of the sidewall portions and a first outer leg portion situated outside the one of the sidewall portions, said second attaching portion includes a second inner leg portion situated inside the other of the sidewall portions and a second outer leg portion situated outside the other of the sidewall portions so that the connecting portion is disposed inside the edge wall portion to connect the first inner leg portion and the second inner leg portion, said first attaching portion is formed in a U-character shape so that the first attaching portion is attached to the one of the sidewall portions from above, and said second attaching portion is formed in a U-character shape so that the second attaching portion is attached to the other of the sidewall portions from above.

7. The electrical connector according to claim 6, wherein said guide member further includes a third attaching portion, and said third attaching portion is formed in a U-character shape so that the third attaching portion is attached to the edge wall portion from above.

* * * * *